US007624891B2

(12) United States Patent
Appelbaum et al.

(10) Patent No.: US 7,624,891 B2
(45) Date of Patent: Dec. 1, 2009

(54) PLASTIC PACKAGE WITH CARD COVER AND FLIP-UP CARD RETAINERS

(76) Inventors: Paul Appelbaum, 16371 Wimbledone La., Huntington Beach, CA (US) 92649; Joseph Campbell, 13802 Tustin E. Dr., No. 47B, Tustin, CA (US) 92780

( * ) Notice: Subject to any disclaimer, the term of this patent is extended or adjusted under 35 U.S.C. 154(b) by 706 days.

(21) Appl. No.: 11/150,065

(22) Filed: Jun. 13, 2005

(65) Prior Publication Data

US 2006/0278651 A1 Dec. 14, 2006

(51) Int. Cl.
*B65D 45/22* (2006.01)

(52) U.S. Cl. ..... 220/326; 220/4.21; 220/784

(58) Field of Classification Search ..... 220/4.21, 220/326, 784, 787, 788, 799, 800
See application file for complete search history.

(56) References Cited

U.S. PATENT DOCUMENTS 855,083 A * 5/1907 Yoha ..... 220/309.2
3,263,393 A * 8/1966 Weber ..... 53/486
3,412,889 A * 11/1968 Virginia et al. ..... 220/788
4,431,114 A * 2/1984 Kleinfeld ..... 220/835
4,776,459 A * 10/1988 Beckerman et al. ..... 206/467
4,986,438 A * 1/1991 Borst ..... 220/315
6,305,546 B1 * 10/2001 Saunders et al. ..... 206/541
6,415,947 B1 * 7/2002 Kim ..... 220/788
6,666,348 B2 * 12/2003 Fore et al. ..... 220/4.21
2003/0205032 A1 * 11/2003 Guiliano et al. ..... 53/486
2006/0060578 A1 * 3/2006 Church et al. ..... 220/4.21
2006/0249522 A1 * 11/2006 Ringo ..... 220/784

* cited by examiner

*Primary Examiner*—Anthony D Stashick
*Assistant Examiner*—James N Smalley

(57) ABSTRACT

A plastic package for holding small articles of commerce has a clear blister portion and a rectangular card member for covering the blister portion, the blister having a bottom, front wall, rear wall, and opposing side walls, and the upper perimeter portion of the blister has a ledge extending therealong for engaging and supporting the periphery of the card, and hingedly attached along upper edges of each of the blister sides is an integral flip-up retainer member each having a "proud" point or convex surface, and when the card is positioned on the blister ledge the hinged retainer members can be rotated to a position which brings their proud points in engagement with the card. UV responsive adhesive on the proud points can be activated to bond the retainers to the card to seal the package.

3 Claims, 4 Drawing Sheets

PLASTIC PACKAGE WITH CARD COVER AND FLIP-UP CARD RETAINERS

BACKGROUND OF THE INVENTION

1. Field of the Invention

The present invention relates generally to clear plastic packages for small articles of commerce. In particular the invention relates to packages that have a clear so-called "blister" part for holding the articles, and a flat card portion for holding printed information and for covering the blister portion.

2. Description of the Prior Art

It has become popular to secure small articles of commerce in clear plastic packages such as clamshell-type packages and card-and-blister packages that permit prospective purchasers a view of the product while providing a seal against tampering and pilferage. The conventional card-and-blister package has a clear blister portion having a periphery that is adhesively attached to the flat surface of a cardboard card member. Such packages can be sealed by applying Heat energy to the back of a cardboard to activate dried adhesive on pre-coated cards. Advances in packaging technology have involved systems that employ UV energy to instantly seal such packages containing UV activated adhesive. In this regard see U.S. Pat. No. 5,259,169 to Appelbaum, et al. which discloses a packaging machine for UV sealing of card-and-blister packages.

Despite these advances certain limitations remain.

SUMMARY OF THE INVENTION

In view of the foregoing it is an object of the present invention to provide an improved, more versatile card-and-blister type package.

Another object is to provide a card-and-blister type package that lends itself to employing cards of all types of material including paper, cardboard, metal, plastic and other various recyclable materials.

A further object is to provide a package that lends itself advantageously to UV adhesive based systems.

These and other objects and advantages are provided by the present invention of a package that has a blister or clear plastic article-receiving portion and a rectangular card member for covering and sealing the blister portion, the blister portion having a bottom, a front wall and rear wall, and opposing side walls, the upper edges of the walls forming a perimeter portion with a support ledge extending therealong for engaging and supporting the periphery of the card member, and including an outer perimeter edge, and the blister portion featuring integral "flip-up" card retainers that are hingedly attached to the outer perimeter edges of at least the two opposing side walls. Each retainer features a prominent or convex part, also called a "proud point" in the U/V package industry, and it can be fully rotated from an open position in which the convex part is upwardly facing to a rotated position in which the convex part is downwardly facing and proximate the card support ledge. When the "flip-up" retainers are in open position the card member can make covering engagement with the blister portion with the lower surface of the card member engaged by the support ledge, and then the retainers can be rotated to their rotated positions to engage the periphery of the card member. Thus the periphery of the card member can be held between the underlying support ledge and the convex portions of the rotated retainers. Convex proud point portions coated with UV adhesive can be instantly bonded to the card member to seal the package.

In a preferred embodiment of the invention each of the opposing ends of the flip-up retainer on the side walls has a foot portion that extends a certain distance in a direction normal to the hinge axis of the retainer. When these retainers are rotated into position they retain the opposing side peripheries of the card, and their foot portions will retain the front and rear peripheries of the card.

In a variant of the invention the foot portions of the side retainer members are adapted to lie in overlapping relationship with the rotated front and rear retainers. In this case the rotated front and rear retainer members have an upwardly facing groove that will embrace the convex portions of the over-lapping foot portions. These grooves and convex portions can be further adapted to snap into locking engagement with each other. These nested parts can be adhesively bonded when UV adhesive, applied to the convex portions, is cured by UV illumination.

Having summarized the invention, it will be further appreciated by reference to the drawings, detailed description and claims which follow.

DETAILED DESCRIPTION OF THE INVENTION

Figure 1:
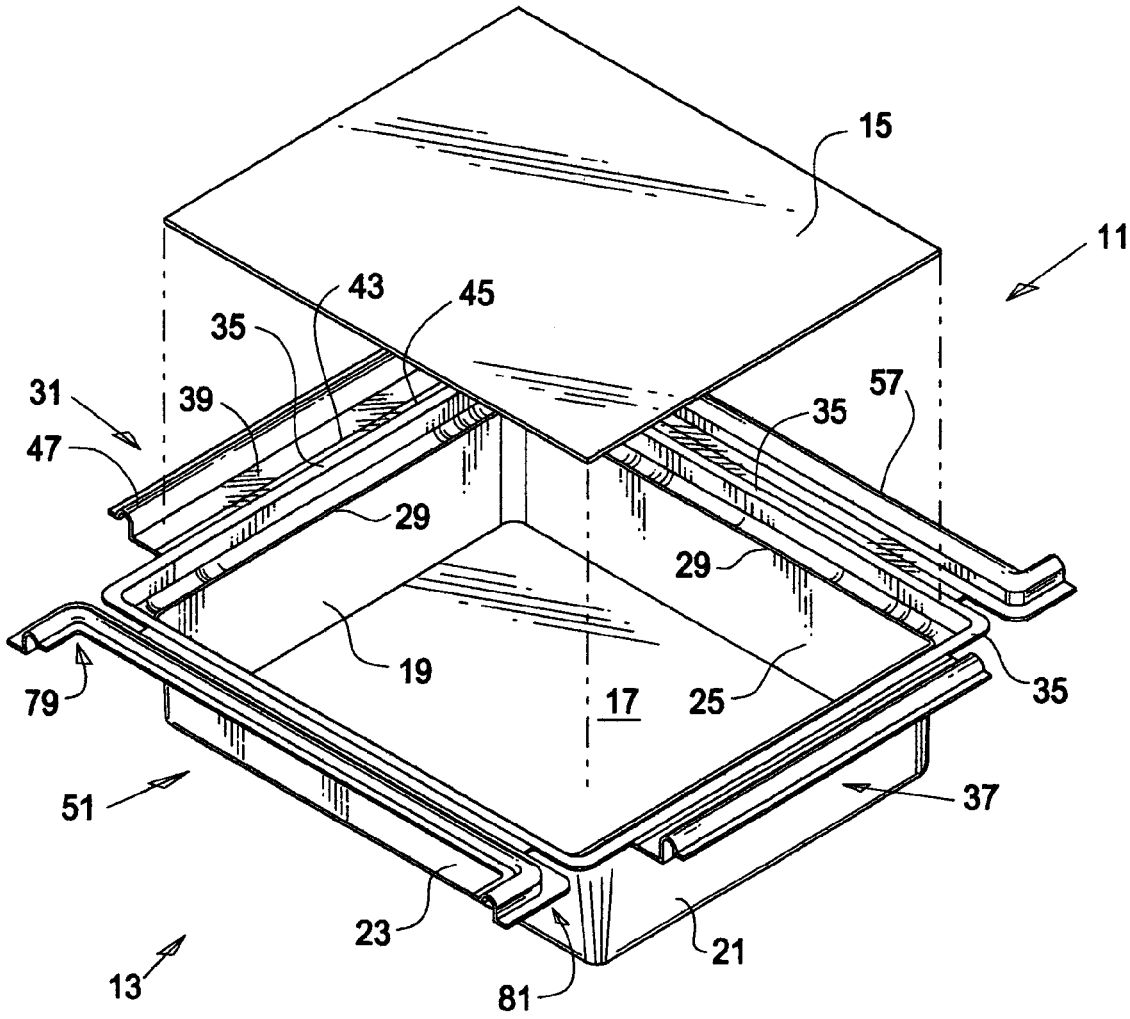
FIG. 1 is a perspective view of a preferred embodiment of a package according to the present invention, showing the clear blister portion with card retainer members in open position, and a card member.

Referring now to the drawings, FIG. 1 shows that a preferred embodiment of a package 11 according to the present invention has a clear plastic "blister" portion 13 and a card portion 15 for covering the blister portion. Blister 13 is formed by conventional techniques in the plastics molding industry, and has a bottom 17, front wall 19, rear wall 21, and opposing sidewalls 23 and 25. A ledge 29, for supporting peripheral portions of the card member 15 in a manner to be described, extends along the upper edges of the blister walls as shown in FIGS. 1 and 3.

Figure 2:
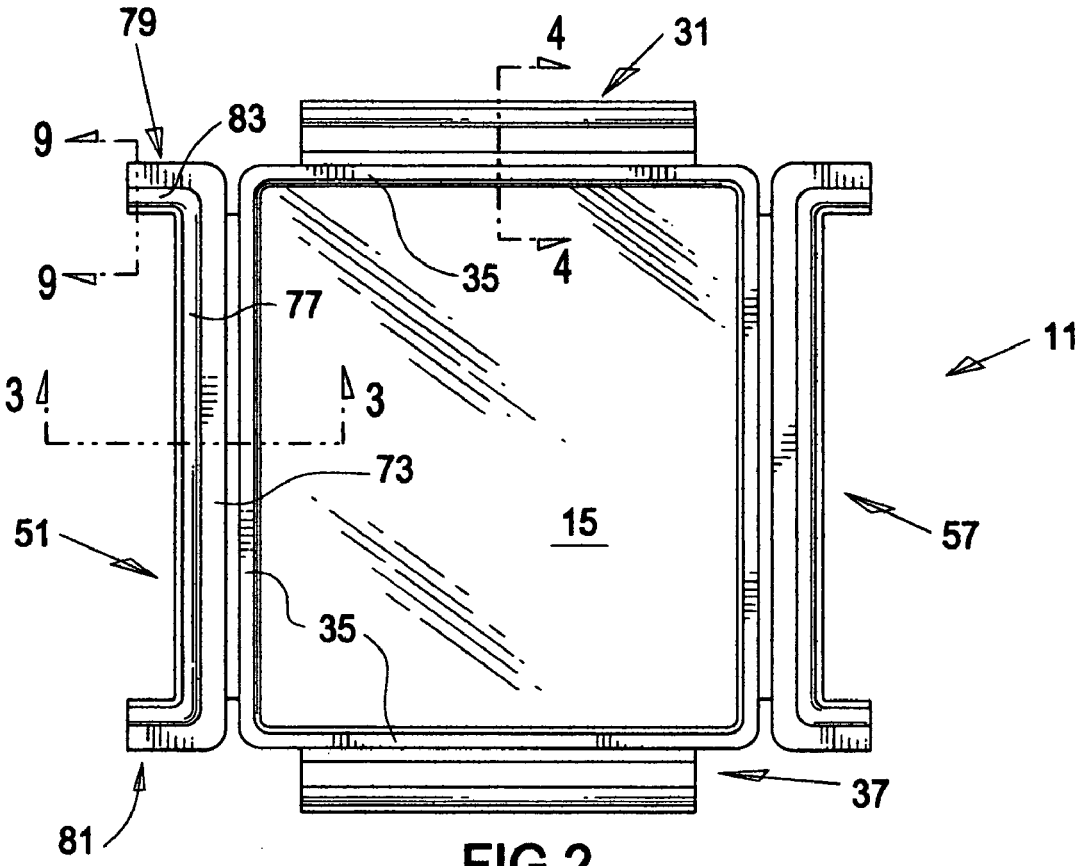
FIG. 2 is a top plan view of the package of FIG. 1, with card in place.
Figure 3:
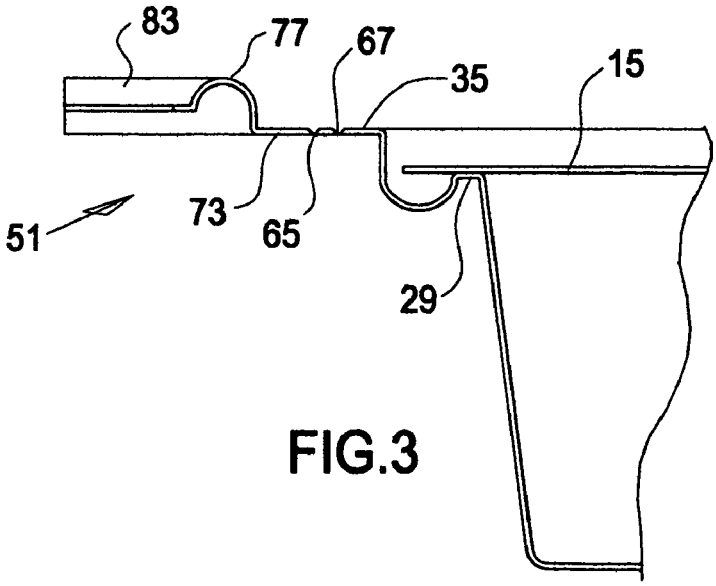
FIG. 3 is an enlarged sectional view taken along the line 3-3 of FIG. 2.

As FIGS. 1, 2, and 3 show, the invention features retainer members 31 and 37 that are attached to the flange 35 at the front and rear of the blister. There are also retainers 51 and 57 on opposing sides of the blister.

Figure 4:
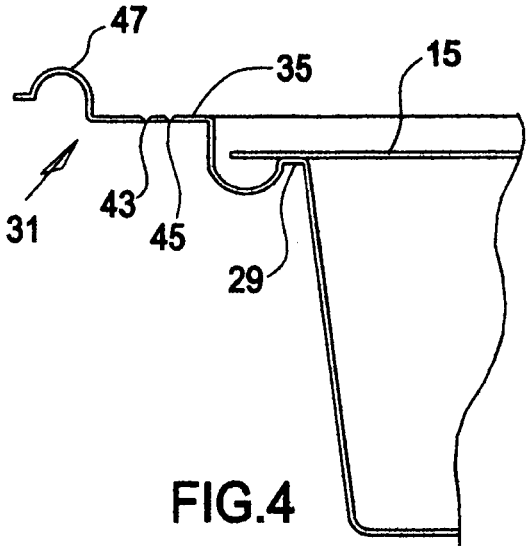
FIG. 4 is an enlarged sectional view taken along the line 4-4 of FIG. 2.

FIGS. 1 and 4 show that retainer 31 has a tab 39 that is connected to the flange 35 by way of a "living hinge" comprised of parallel hinge channels 43 and 45. Retainer 31 has a convex portion or "proud point" 47 which is adapted to engage and retain peripheral portions of the card 15 when fully rotated inwardly in a manner to be described. Convex portion 47 can also (in a UV system) be wetted by liquid UV adhesive and rotated into contact with the card 15 for subsequent bonding to it, in a manner to be described hereinafter. The rear retainer 37 is has a construction that mirrors that of the afore-described retainer 31.

Figure 9:
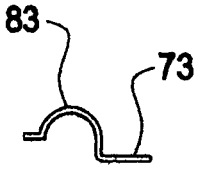
FIG. 9 is a sectional view taken along the line 9-9 of FIG. 2.

Regarding retainers 51 and 57, shown in FIGS. 1-3, FIG. 3 shows in cross section that retainer 51 is similarly configured to retainer 31, afore-described, and has a "living hinge" created by conventional hinge channels 65 and 67, and includes a web 73 which adjoins a male portion including a convex portion 77. Note however that opposite ends of the retainer 51 have foot portions 79 and 81 extending at right angles to the hinge channels. FIG. 9 shows how the feet have a sectional configuration like that of the main part of retainer 51 including a convex part 83. It will be seen that when retainer 51 is fully rotated the foot portions will cooperate with the retainers 31 and 37 to also engage the front and rear peripheries of the card, while the main part of retainers 51 and 57 hold the opposing side of the card.

Retainer 57 has a configuration that mirrors that of the afore-described retainer 51.

Card 15 has a generally rectangular shape, and can be constructed of various suitable materials including plastic, cardboard, and metal, and is sized to effectively cover the article-receiving blister portion with its flat peripheral portion engaging and supported by the ledge 29 as best shown in FIG. 3. Note that although the card periphery is flat, the invention contemplates that the major portion of the card can be variously shaped, as desired (to suit the packaged articles, for example).

Figure 6:
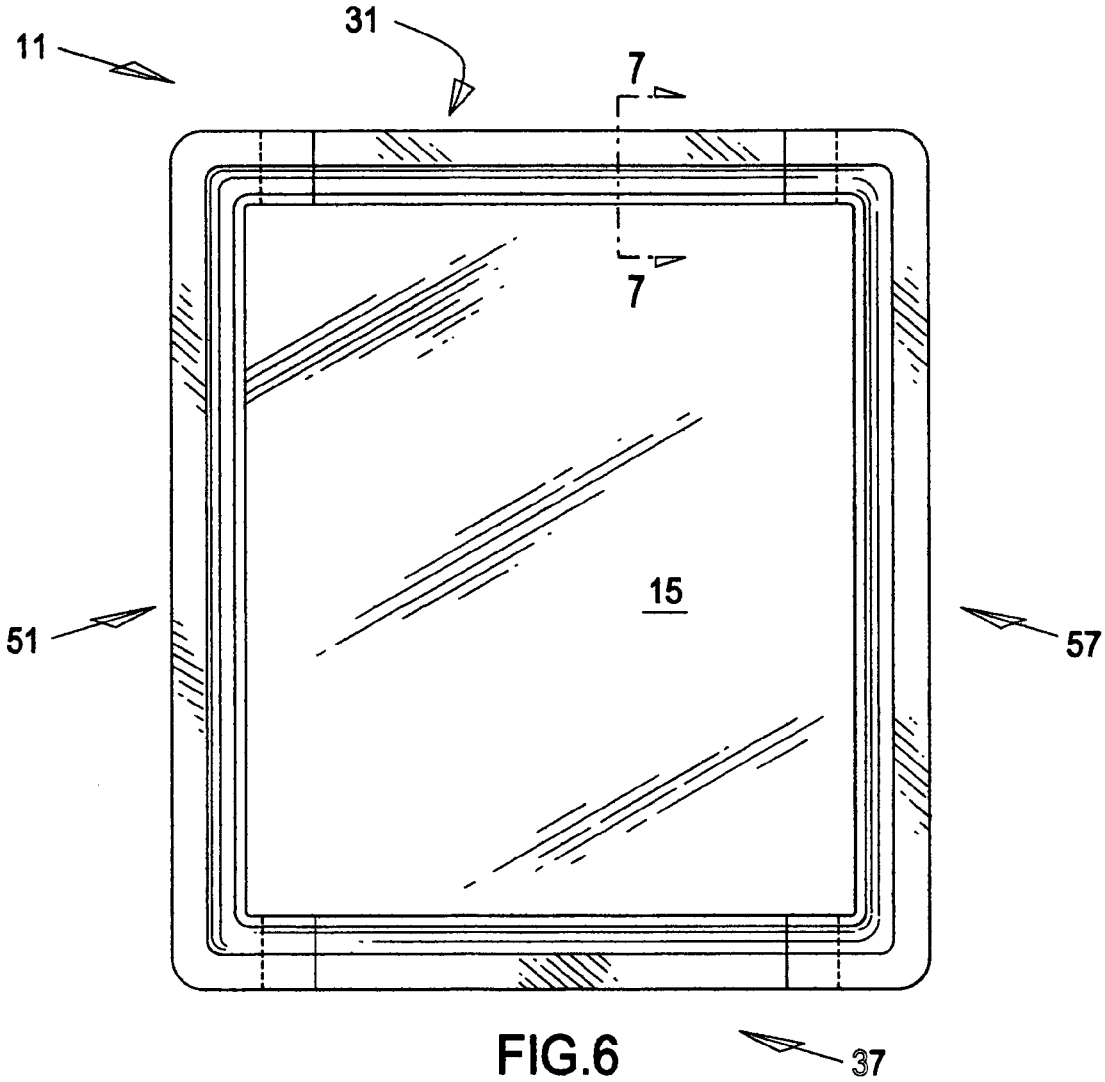
FIG. 6 is a top plan view of the package of FIG. 1, in sealed configuration.

When card 15 is positioned on the support ledge 29 all four retainers can be rotated from their "open positions" illustrated in FIG. 1 to fully rotated positions so as to hold the card in place, forming a sealed package 11, shown in FIG. 6.

Figure 5:
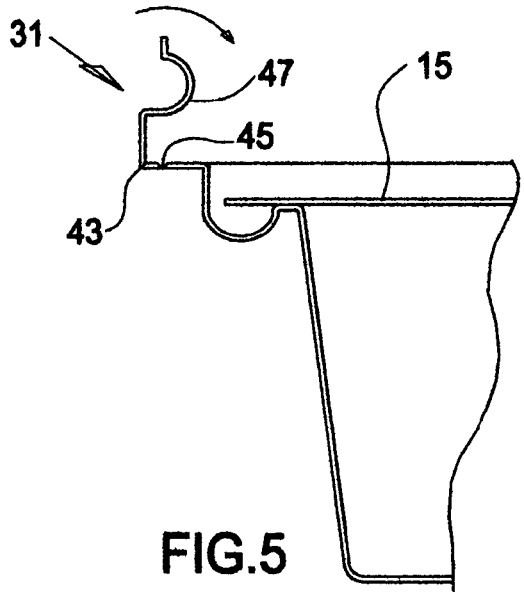
FIG. 5 is an enlarged sectional view showing rotation of the retainer member shown in FIG. 4.
Figure 7:
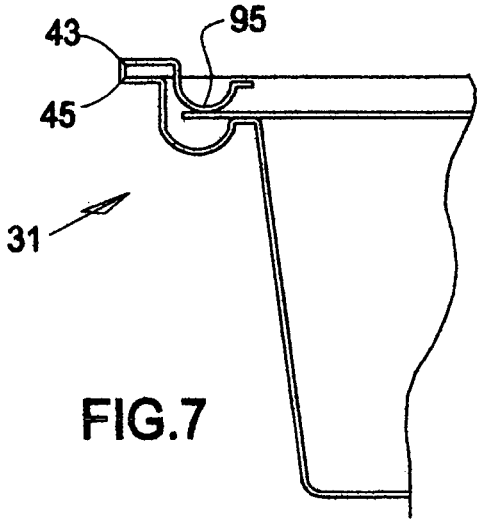
FIG. 7 is an enlarged sectional view taken along the line 7-7 of FIG. 6.

The operation of the retainers is best understood by reference to retainer 31 as shown in FIGS. 4, 5 and 7. Note how the channel lines 43 and 45 provide axes allowing rotation of retainer 31 from the open position of FIG. 4 through the position shown in FIG. 5 to the fully rotated position of FIG. 7 with the convex portion and the support ledge cooperating to retain card 15.

In one variant of the invention the blister has one pair of retainers, i.e. opposing side retainers, with foot portions, only. Note that in this variant the feet can have sufficient length so as, when rotated in place, to engage a substantial part or the entire front and rear parts of the card.

Figure 8:
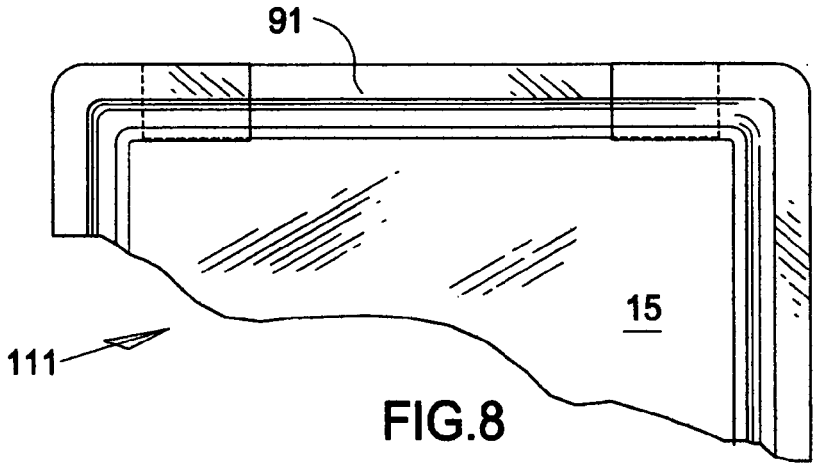
FIG. 8 is a partial top plan view of a variant of the present invention.

In another variant of the invention, the package 111 shown in FIG. 8, the concave underside 95 of the retainer 31 shown in FIG. 7, is designed to receive the convex part of the foot portions of retainers 51 and 57, which foot portions are sufficiently long to lie in overlapping relationship with the front and rear retainer. Thus when the retainers 91 and 93 are first rotated in position the side retainers can then be rotated to have their foot portions overlap the front and rear retainers. Conventional interlockable features can be formed in the overlapping portions to allow them to snap-lock into engagement. UV adhesive on the overlapping portions can be used to bond them together.

While particular embodiments of the invention have been shown, it is not intended that the invention be limited thereto. Various modifications and variations of the invention will be evident to persons of ordinary skill in the art, given the benefit of this disclosure, and it is intended that the invention be given its full scope and breath as defined in the claims that follow.

What is claimed is:

1. A package for small articles, said package having a clear plastic blister portion for holding said articles and a card for covering said blister portion, wherein:

a) said card has a generally flat rectangular periphery; and wherein b) said blister portion has a bottom, a front wall, rear wall, and opposing side walls, the upper edges of the walls forming an upper perimeter portion for said blister portion and including an outer edge, and a perimeter portion having means for engaging and vertically supporting said card periphery; and c) retainer means hingedly attached to said outer edges of said front and rear walls, and each said opposing side walls respectively, for rotation from a position away from said support means to a position proximate said support means, for engaging said card periphery when said card is positioned on said support means; and wherein each said retainer means includes a prominent portion for engaging said card periphery; and wherein said retainer means on said opposing side walls extend longitudinally along said outer edges of said opposing side walls, and a foot portion at opposite ends of each said side wall retainer means extending for a predetermined distance in a transverse direction, said foot portion adapted to be rotated into position proximate said support means on the front and rear perimeter portions of said blister, and adapted for engaging the front and rear of said card periphery; and wherein said foot portions are adapted to engage and to lie in overlapping relationship with said retainer means on said front and side walls.

2. A package as defined in claim 1 wherein said overlapping portions are adapted to snap into locking engagement with each other.

3. A package as defined in claim 2 wherein said retainer means on said front and rear walls have recessed portions for receiving the prominent portions of said foot portions.

* * * * *